US006386296B1

(12) United States Patent
Kothari et al.

(10) Patent No.: US 6,386,296 B1
(45) Date of Patent: May 14, 2002

(54) METHOD AND APPARATUS OF PROTECTING EXPLOSIVES

(75) Inventors: Manish Kothari, Stafford; Wenbo Yang; Alfredo Fayard, both of Sugar Land; Anthony F. Veneruso, Missouri City; Larry A. Behrmann, Houston; Jack F. Lands, West Columbia; Claude D. Jones, Sugar Land, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/596,612

(22) Filed: Jun. 19, 2000

(51) Int. Cl.[7] ..... E21B 29/02; E21B 43/11; E21B 43/117; F42B 3/08; C06B 45/00

(52) U.S. Cl. ..... 175/4.59; 175/4.6; 166/63; 166/297; 89/1.15; 102/318; 149/108.8

(58) Field of Search ..... 89/1.15; 102/307, 102/313, 314, 318, 476; 149/109.4, 108.8; 166/55, 63, 297; 175/4.5, 4.57, 4.59, 4.6

(56) References Cited

U.S. PATENT DOCUMENTS 4,061,511 A * 12/1977 Baczuk ..... 149/19.9
4,191,265 A * 3/1980 Bosse-Platiere ..... 175/4.56
4,352,376 A 10/1982 Norwood
4,636,934 A 1/1987 Schwendemann et al.
4,649,822 A * 3/1987 Seeman ..... 102/275.1
5,859,383 A * 1/1999 Davison et al. ..... 102/307
6,021,714 A * 2/2000 Grove et al. ..... 102/307

OTHER PUBLICATIONS

Lewis, Sr., Richard J., Hawley's Condensed Chemical Dictionary, Van Nostrand Reinhold Company, 12th Edition, p. 791.*

* cited by examiner

*Primary Examiner*—David Bagnell
*Assistant Examiner*—Jennifer H Gay
(74) *Attorney, Agent, or Firm*—Trop, Prunet & Hu P.C.

(57) ABSTRACT

A method and apparatus to protect explosive components used in various tools, such as tools for use in wellbores, includes a component with an adsorptive material. Example tools include perforating gun strings that include shaped charges, detonating cords, and booster explosives. Other tools may include surface tools containing explosive components. In these tools, a build up of corrosive gases or liquids may occur, which may cause damage to the explosive components. As a result, the structural integrity or reliability and thermal stability may be weakened or reduced. To reduce the amount of build up of corrosive gases or liquids, an adsorptive material is placed inside tools in the proximity of explosive components.

44 Claims, 7 Drawing Sheets

METHOD AND APPARATUS OF PROTECTING EXPLOSIVES

BACKGROUND

The invention relates to protecting explosives, such as explosives used in downhole environments.

One operation that is performed in completing a well is the creation of perforations in a formation. This is typically done by lowering a perforating gun string to a desired depth in a wellbore and activating the gun string to fire shaped charges. The shaped charges when fired create perforating jets that form holes in surrounding easing as well as extend perforations into the surrounding formation.

Various types of perforating guns exist. One type of perforating gun includes capsule shaped charges that are mounted on a strip in various patterns. The capsule shaped charges are protected by individual containers or capsules from the harsh wellbore environment. Another type of perforating gun includes non-capsule shaped charges, which are loaded into a sealed carrier for protection. Such perforating guns are sometimes also referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. In a hollow-carrier gun, charges shoot through the carrier into the surrounding casing formation.

The reliability of wellbore perforating guns depends on the mechanical properties and performance of many precise components and materials that are exposed to hostile conditions (e.g., high temperatures, mechanical shock and vibration, and so forth). Explosive components may also be degraded by water or vapor and other corrosive gases or liquids that are generated within the guns themselves. Typical explosive components in a perforating gun includes shaped charges and detonating cords. As shown in FIG. 1, a shaped charge 10 typically includes a main explosive charge 16 and a metallic liner 20, both contained in an outer case 12. A primer charge 14 coupled to the back of the main explosive charge 16 is ballistically connected to a detonating cord 24. A detonation wave traveling down the detonating cord 24 transfers energy to the primer charge 14, which in turn initiates the main explosive 16. Detonation of the main explosive 16 causes the liner 20 to collapse to form a perforating jet.

The following are examples of damage that may be caused to explosive components in a corrosive environment, which may contain water vapor and other gases. The outer jacket of the detonating cord may be damaged, which may increase the likelihood that the detonating cord may break resulting in the guns not firing. Damage to the outer jacket of a detonating cord may also be a safety hazard. The detonating cord may be accidentally pinched which may cause it to initiate.

The corrosive environment also desensitizes explosive materials in the detonating cords, shaped charges, or other components, which may cause a perforating gun to not fire. When a perforating gun string is lowered to a desired depth but for some reason cannot be activated, a mis-run has occurred. This requires that the perforating gun string be pulled out of the wellbore and replaced with a new gun string, which is time consuming and expensive. Also, retrieving a mis-fired gun from a wellbore may be a hazardous operation.

In addition, an explosive has a certain range of time and temperature in which the explosive is thermally stable. If the explosive is stretched beyond this range, the explosive starts to decompose, bum, or auto-detonate. The presence of water vapor acts as a catalyst that further accelerates the rate of decomposition of the explosive. Other products of decomposition may also act as catalysts in accelerating the decomposition.

A need thus exists for a method and apparatus to protect explosives in a corrosive environment and to reduce effects of explosive decomposition which may occur downhole or at the surface.

SUMMARY

In general, according to one embodiment, an apparatus includes a housing, an explosive in the housing, and a material placed in the housing and in the proximity of the explosive to remove corrosive fluid to protect the explosive.

Other embodiments and features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
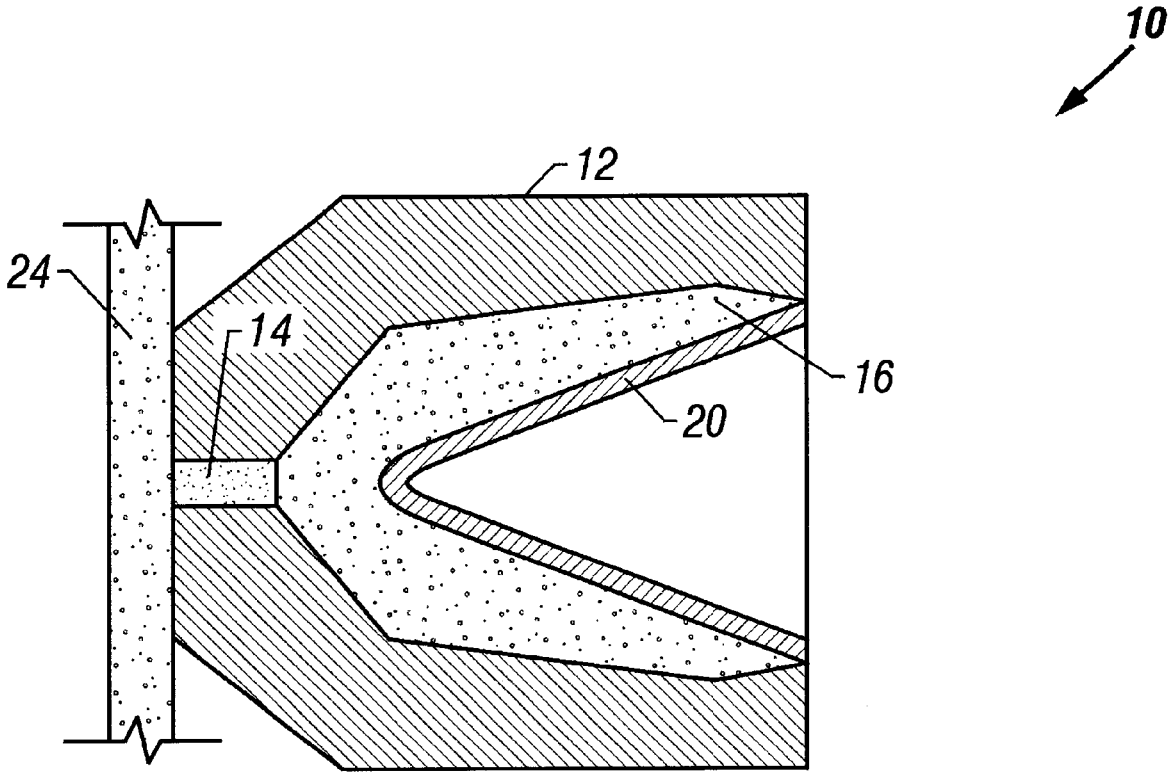
FIG. 1 (Prior Art)
FIG. 1 illustrates a conventional shaped charge.
Figure 2:
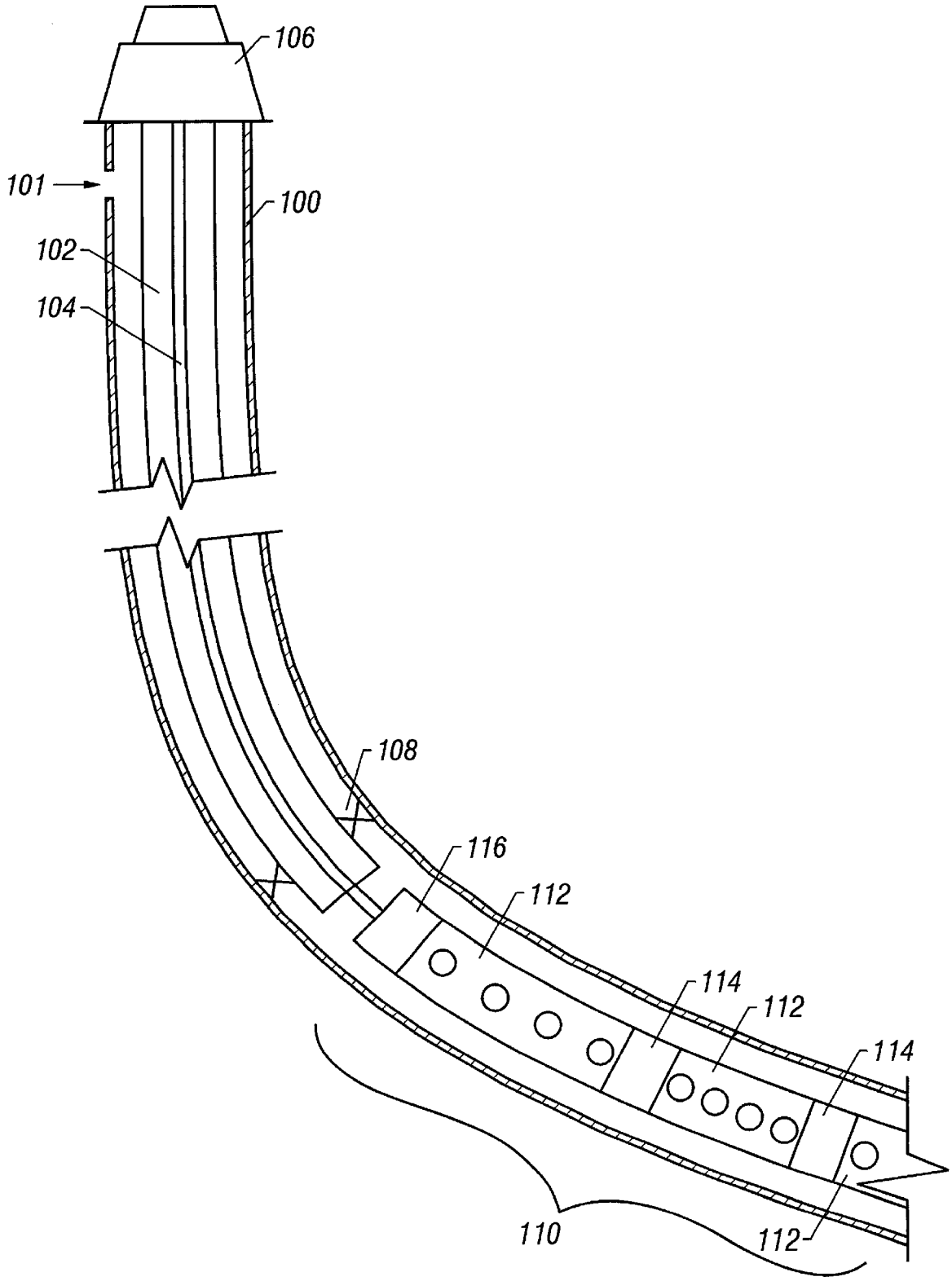
FIG. 2 illustrates an embodiment of a completion string having a perforating gun string with plural guns coupled by adapters.

Referring to FIG. 2, an example completion string in a wellbore 101 is illustrated. The wellbore 101 may be lined with casing 100, and a production tubing 102 may be positioned inside the casing 100 to provide a conduit for well fluids to wellhead equipment 106. A packer 108 isolates an annular region between the production tubing 102 and the casing 100. A perforating gun string 110, which may be attached to a carrier 104 (e.g., wireline, slickline, or coiled tubing) may be lowered through the tubing 102 to a target depth in the wellbore 101.

To achieve a desired length, the perforating gun string 110 may include multiple guns 112. An example length of each gun 112 may be about 20 feet. To make a perforating gun string of a few hundred feet or longer, several guns are connected together by adapters 114. Each of the adapters 114 contains a ballistic transfer component, which may be in the form of donor and receptor booster explosives. Ballistic transfer takes place from one gun to another as the detonation wave jumps from the donor to the receptor booster. At the end of the receptor booster is a detonating cord that carries the wave and sets off the shaped charges in the next gun 112.

Figure 3:
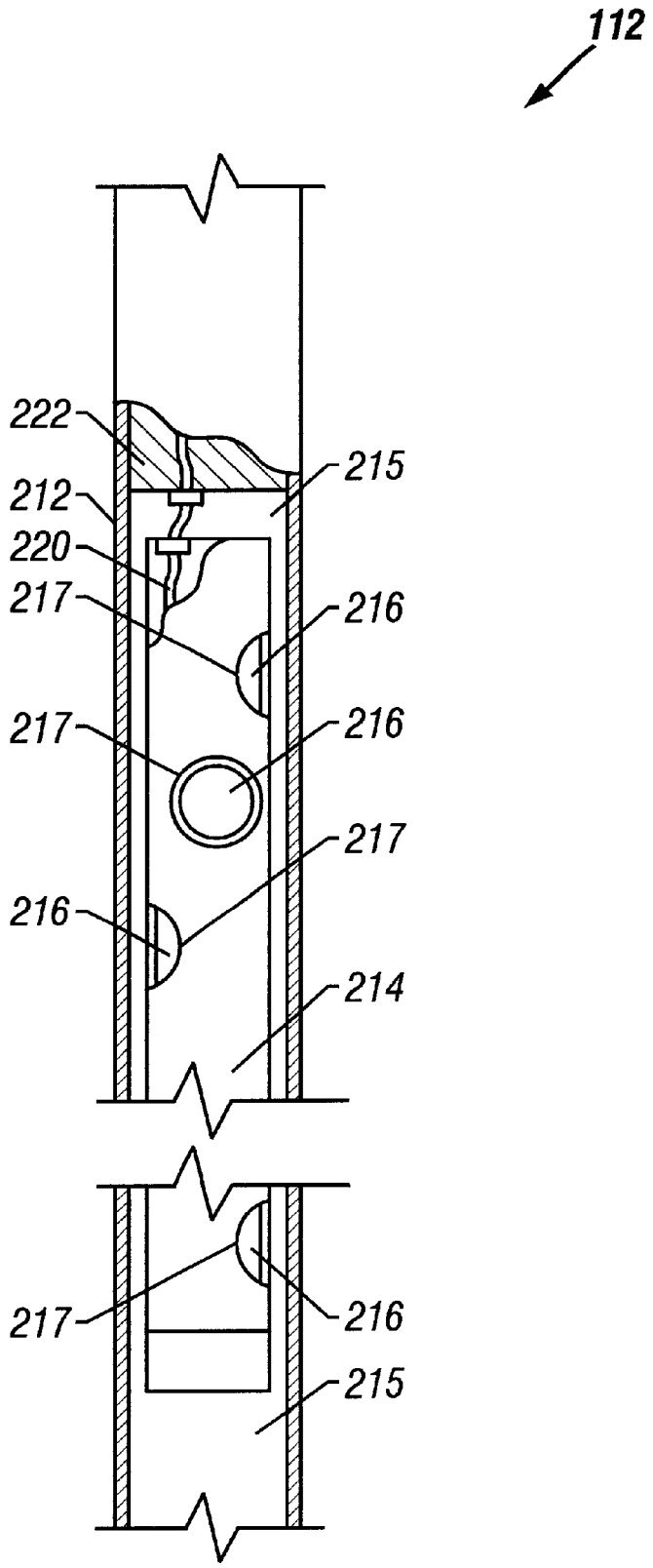
FIG. 3 illustrates a hollow carrier gun useable in the perforating gun string of FIG. 2.

Referring to FIG. 3, each gun 112 may be a hollow carrier perforating gun that includes a carrier 212 that has an inner chamber 215 to contain a loading tube 214, which provides a housing for explosive components of the perforating gun 112. The carrier 212 is sealed to protect components inside the carrier from the wellbore environment. The loading tube 214 includes a number of openings 217 proximal which shaped charges 216 may be mounted. In the illustrated embodiment, the loading tube 214 includes shaped charges 216 arranged in a spiral arrangement to perforate in a plurality of directions. In alternative embodiments, other phasing patterns may be used.

A detonating cord 220 extends through an upper bulkhead 222 of the gun carrier 212 and an upper portion of a carrier chamber 215 to the loading tube 214. The detonating cord 220 is passed into the loading tube 214 for connection to the shaped charges 216. Examples of explosives that may be used in the various explosive components (e.g., shaped charges 216, detonating cord 220, and boosters) include RDX, HMX, HNS, TATB, and others.

The presence of corrosive gases (including water vapor or other gases) or other corrosive fluids in each perforating gun 112 or adapter 114 has been found to cause problems, especially at high temperatures (e.g., above about 1000° C). Moisture trapped in the carrier 212 (such as during assembly) or adapter 114 creates water vapor. In addition, pollutants may also be trapped during assembly and other corrosive gases may be emitted by various components in the perforating gun, including explosive components. Water vapor together with the other gases may create a corrosive environment within the gun 112 or adapter 114. A corrosive environment may cause certain components to warp, become brittle, or lose strength. For example, the corrosive environment may damage the outer protective jacket of the detonating cord 220, which may cause the detonating cord 220 to break or mis-fire and prevent firing of the gun 112. Also, if the outer jacket of the detonating cord 220 is damaged, a safety hazard is created since the detonating cord 220 may be pinched to set it off.

Furthermore, explosives have certain ranges of time and temperature in which they are thermally stable. If they are stretched beyond this time and temperature range, explosives may start to decompose, bum, or auto-detonate. Decomposition of the explosives creates products (referred to as out-gassing), which may include corrosive gases. Presence of water vapor and other gases acts as a catalyst in accelerating the decomposition of the explosive. Due to decomposition, the reliability, performance, and stability of explosive components may become compromised.

As used here, the term "corrosive gas" refers to any form of gas that may cause damage to or reduce the structural integrity, chemical integrity or stability, or other characteristic of an explosive component. The term "corrosive fluid" refers to any gas or liquid that may do the same.

In accordance with some embodiments of the invention, materials may be placed proximal explosives in tools to remove corrosive fluids to protect the explosives. Removal refers to adsorption, trapping, reaction, and any other interactions with the corrosive fluids to reduce their effect on the explosives, even at elevated temperatures. As used here, "explosives" may also refer to propellants used in various applications. The protective materials may react with corrosive fluids to lessen their adverse effect on explosives. The protective materials may also prevent or reduce the reaction of corrosive fluids with explosives so that the explosives maintain their integrity despite presence of corrosive fluids.

In one embodiment, components having adsorptive materials may be placed inside the perforating gun 112 or adapter 114 (or any other tool containing explosive components) to adsorb water vapor and other corrosive gases that may be present. The adsorptive materials may also be capable of adsorbing liquids in addition to gases. In the ensuing discussion, protection of explosives is performed using adsorptive materials; however, in further embodiments, other forms of protective materials as discussed above may be employed.

The adsorptive materials are effective at relatively high temperatures (e.g., greater than about 140° F.). Some adsorptive materials are capable of effective performance at even higher temperatures, such as greater than 200° F. up to 600° F. or even higher. Zeolite (discussed below) is one example of an adsorptive material that is effective at high temperatures. In contrast, typical desiccants used in surface applications are usually effective at or near room temperature but become ineffective if the temperature is raised. Also, typical surface desiccants are designed to adsorb water vapor.

Adsorption refers to adhesion or trapping of gases, solutes, or liquids in solid bodies or liquids. By using components having an adsorptive agent, corrosive gases or liquids may be adsorbed, thereby reducing the amount of such gases so that likelihood of damage to explosive components in the gun 112 and adapter 114 is decreased. Examples of adsorptive agents include alumina, activated charcoal, calcium-aluminosilicate, montmorillonite clay porcelain, silica gel, the family of molecular sieves based on organosilicates or organoaluminosilicates, or metalsilicate molecular sieves such as aluminophosphates. The adsorptive material selected may be based on the target gases or liquids that are to be adsorbed. Some materials are better able to adsorb certain gases or liquids than other materials. The pore sizes and chemical structures of the different adsorptive materials are varied to target different gases or liquids.

In one embodiment, the adsorptive material selected may include a type of molecular sieve containing a high-temperature desiccant called zeolite. Zeolite is made of sodium aluminosilicate, and has the ability to adsorb water molecules as well as other types of molecules with larger diameters such as aromatic branched-chain hydrocarbons. One formula for zeolite is $Na_{86}[(AlO,)_{86}(SiO_2)_{106}]x\ H_2O$. The nominal pore size for zeolite is approximately 10 Angstroms. The pores in the zeolite trap molecules having smaller diameters. Zeolite is available in powder, pellet, or bead form. A component including zeolite may be referred to as a "desiccant module"; however, in further embodiments, other modules or components including other types of adsorptive materials (or combinations of adsorptive materials) may be employed.

The adsorptive material is designed to remove a substantial amount of corrosive fluid form a given environment, such as within a housing or container. A "substantial" amount refers to an amount removed that is effective in protecting an explosive from damage or extending the effective life of the explosive.

Figure 4:
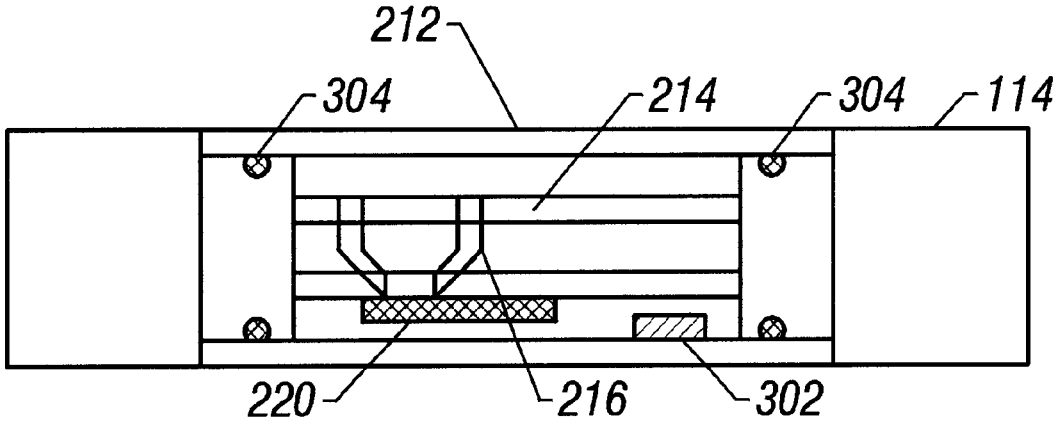
FIG. 4 illustrates components inside the hollow carrier gun including a module containing an adsorptive material in accordance with one embodiment.

Referring to FIG. 4, one or more desiccant modules 302, which may be in the form of a bag, a box, or other configuration, are placed inside the hollow carrier 212. The desiccant module 302 may be placed inside the carrier 212 proximal explosive components in the gun 114, which includes the shaped charges 216 and the detonating cord 220. As shown in FIG. 4, O-ring seals 304 may be provided to hermetically seal the explosive components inside the hollow carrier 212. The one or more desiccant modules 302 reduce the amount of corrosive gases that can build up in the hollow carrier 212.

Figure 5:
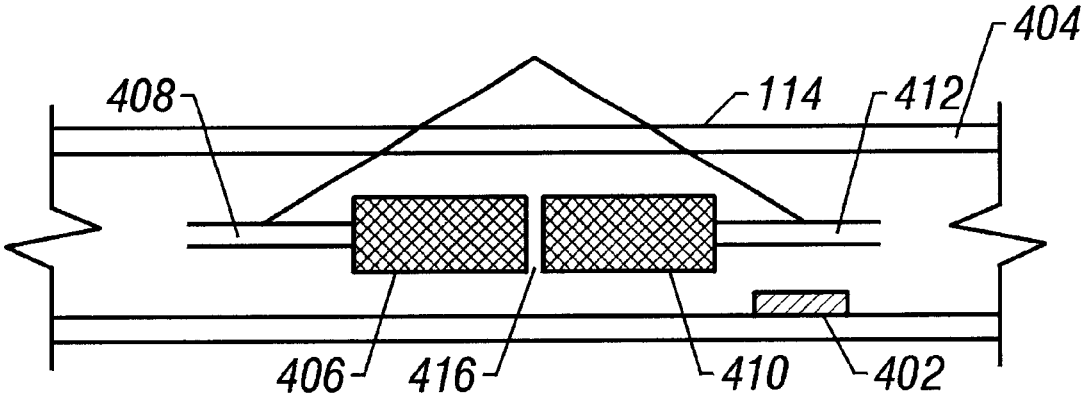
FIG. 5 illustrates components inside an adapter including a module containing an adsorptive material in accordance with an embodiment.

Referring to FIG. 5, one or more desiccant modules are 402 are placed inside a housing 404 of an adapter 114. The adapter may include a donor booster explosive 406 and a receptor booster explosive 410. The donor booster explosive 406 is ballistically coupled to a first detonating cord 408, while the receptor booster explosive 410 is ballistically coupled to a second detonating cord 412. A detonation wave travelling down the first detonating cord 408 is transferred to the donor booster 406, which initiates to transfer the detonation across a gap 416 to the receptor booster explosive 410. Initiation of the receptor booster explosive 410 causes initiation of the detonating cord 412. The adapter housing 404 may be similarly sealed as the gun carrier 212. To prevent buildup of corrosive gases or liquids inside the adapter housing 404, one or more desiccant modules 402 may be placed in the adapter housing 404.

In either the gun carrier 212 or the adapter housing 404, corresponding desiccant modules 302, 402 may be placed in the "proximity" of explosive components. As used here, the term "proximity" or "proximal" refers to a distance of a desiccant module (or other component including an adsorptive material) with respect to an explosive component the desiccant module is intended to protect that allows the desiccant to remain effective. Thus, as shown in FIG. 4, the desiccant module 302 may be placed at one end of the hollow carrier 212 although it may provide effective protection for a shaped charge and a portion of the detonating cord that is at the other end of the hollow carrier 212. Thus, the desiccant module 302 is "proximal" or "in the proximity of" the explosive component if the desiccant module is able to perform its intended task of adsorbing corrosive gases or liquids to protect the explosive component.

Figure 8:
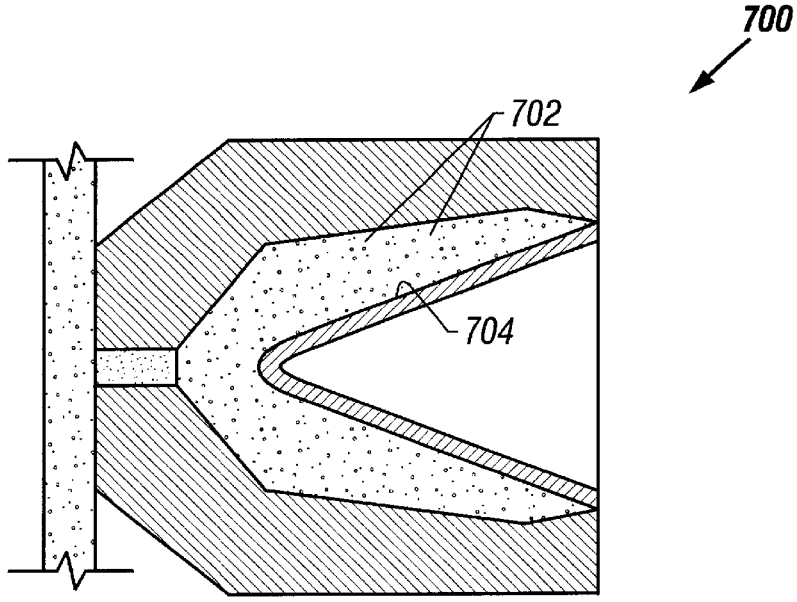
FIGS. 8 and 9 illustrate other embodiments of explosive components having adsorptive material.
Figure 9:
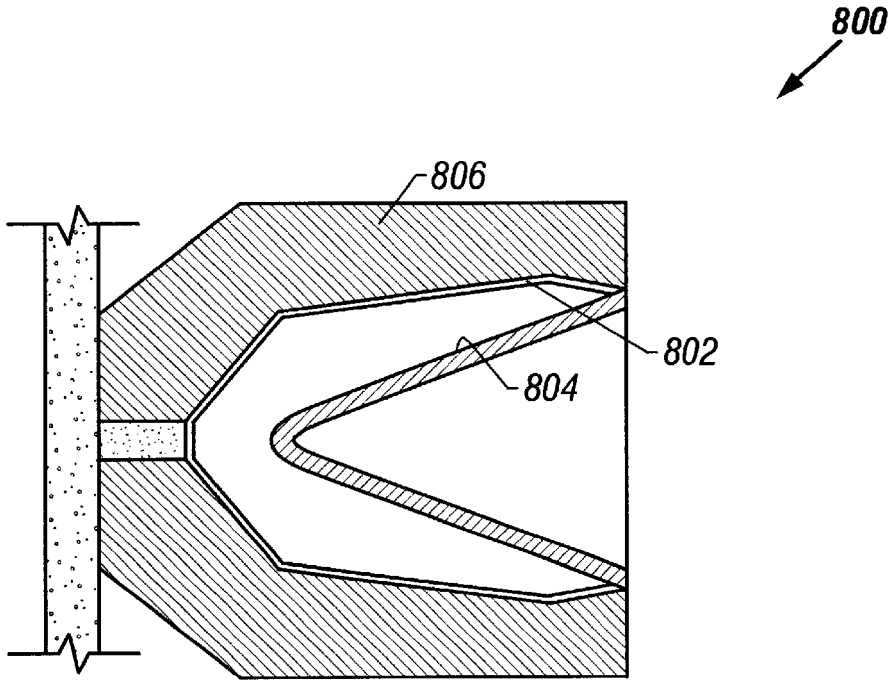

Instead of using modules containing the adsorptive material, other embodiments may have the adsorptive materials mixed with the explosive, such as in a shaped charge 700 shown in FIG. 8. The adsorptive material 702, which may be in powder or pellet form, is mixed with the explosive 704. In another embodiment, a layer 802 of adsorptive material in a shaped charge 800 may be placed between the explosive 804 and a container 806. In other embodiments, a layer of the adsorptive material may be formed on the inner surface of a housing or container in which an explosive is placed. Also, the explosive may be melted with the adsorptive material.

Figure 6:
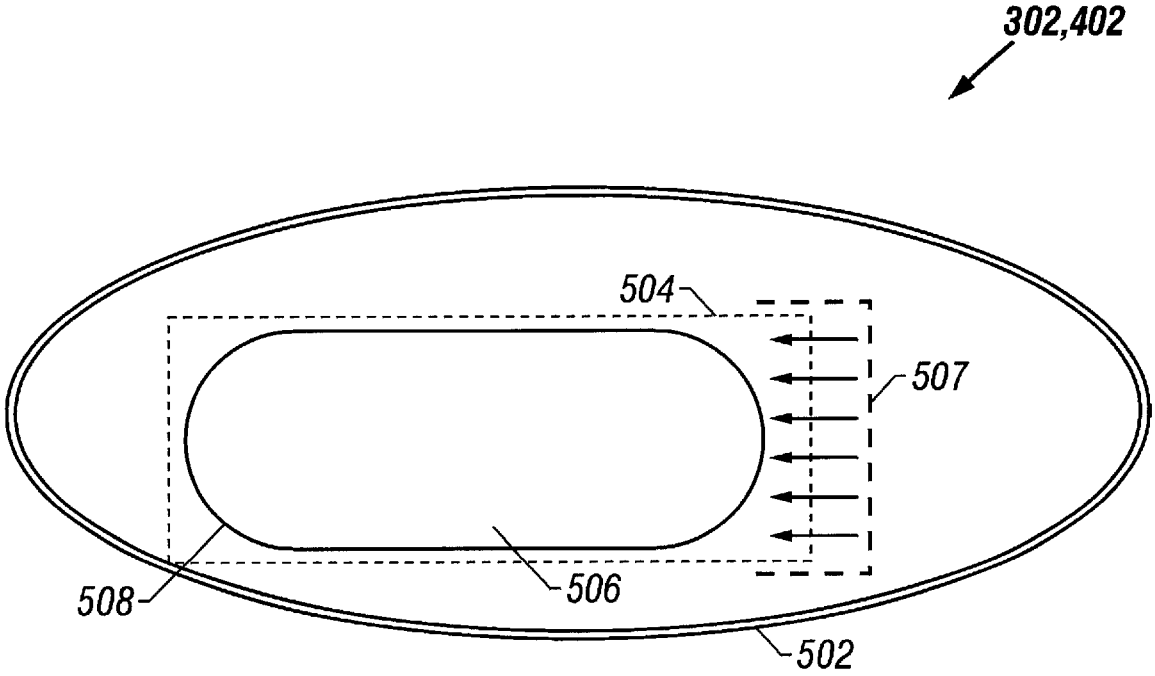
FIG. 6 illustrates a module containing an adsorptive material in accordance with an embodiment usable in the hollow carrier gun or adapter of FIG. 4 or FIG. 5.

Referring to FIG. 6, one embodiment of the desiccant module 302, 402 is illustrated. The desiccant module includes a pouch 520 in which is placed in a container 504 that contains a chemically adsorptive agent 506, which may be in pellet, powder or bead form. The adsorptive agent 506, in pellet, powder, or bead form, may be wrapped by a wrapper or cover 508. The wrapper or cover 508 may be made of TEFLON (tetrafluoroethylene), for example. A cap 507 fits over an opening of the container 504. To protect the container 504 and adsorptive agent 506 during shipment and storage, the container 504 may be sealed within the outer pouch 502. The outer pouch 502 may be made of an aluminized or other metalized plastic film. The film may be made of a thermoplastic material, such as aluminized polypropylene, polyethylene, and others. The film protects the adsorptive material 506 against premature exposure to the atmosphere because a thin layer of metal is effectively impervious to gases.

The body of the module 504 may be made of a metal screen or mesh, such as a metal screen or mesh found in a colander or tea strainer. The body may also be made of a high-temperature porous plastic or a rigid plastic such as PEEK polyetheretherketone (from Victrex Plc) or RYTON® polyphenylene sulfide (from Phillips Petroleum Company) with holes formed in the material. Any other type of container may be used which includes one or more openings.

During installation into the gun system, the outer pouch 502 is opened and the container 504 removed for placement inside the gun system (hollow carrier or adapter). Installation time is not critical because of the presence of the wrapper 508. As the gun assembly is screwed shut, the push-in cap 507 with a sharp set of points may pierce the wrapper 508 to expose the desiccant agent 506. Alternatively, the cover or wrapper 508 may melt or evaporate at a predetermined temperature.

A method and apparatus has been described to protect explosive components in various tools, such as tools for use in wellbores. For example, the tools may include perforating gun strings that contain sealed chambers in which corrosive gases (such as water vapor and other gases) or liquids may build up. This may occur in capsule shaped charges, sealed hollow carriers of guns, for example, or in adapters connecting guns. In each perforating gun, typical explosive components include shaped charges and detonating cords. In adapters, explosive components may include booster explosives, such as donor and receptor boosters. A buildup of corrosive gases may cause damage to or reduce the performance or reliability of the explosive components, which may result in a mis-fire. A hazard may also be caused by the presence of the corrosive gases, since certain components may be more susceptible to accidental detonation. For example, a detonating cord with its plastic wrapping damaged may be pinched, which may cause the detonating cord to initiate. An adsorptive material placed inside tools containing explosive components reduces the amount of corrosive gas build-up. In addition, by adsorbing water vapor and other gases, the rate of decomposition of explosives may be slowed, even at relatively high temperatures. This extends the stability of explosives.

Figure 7:
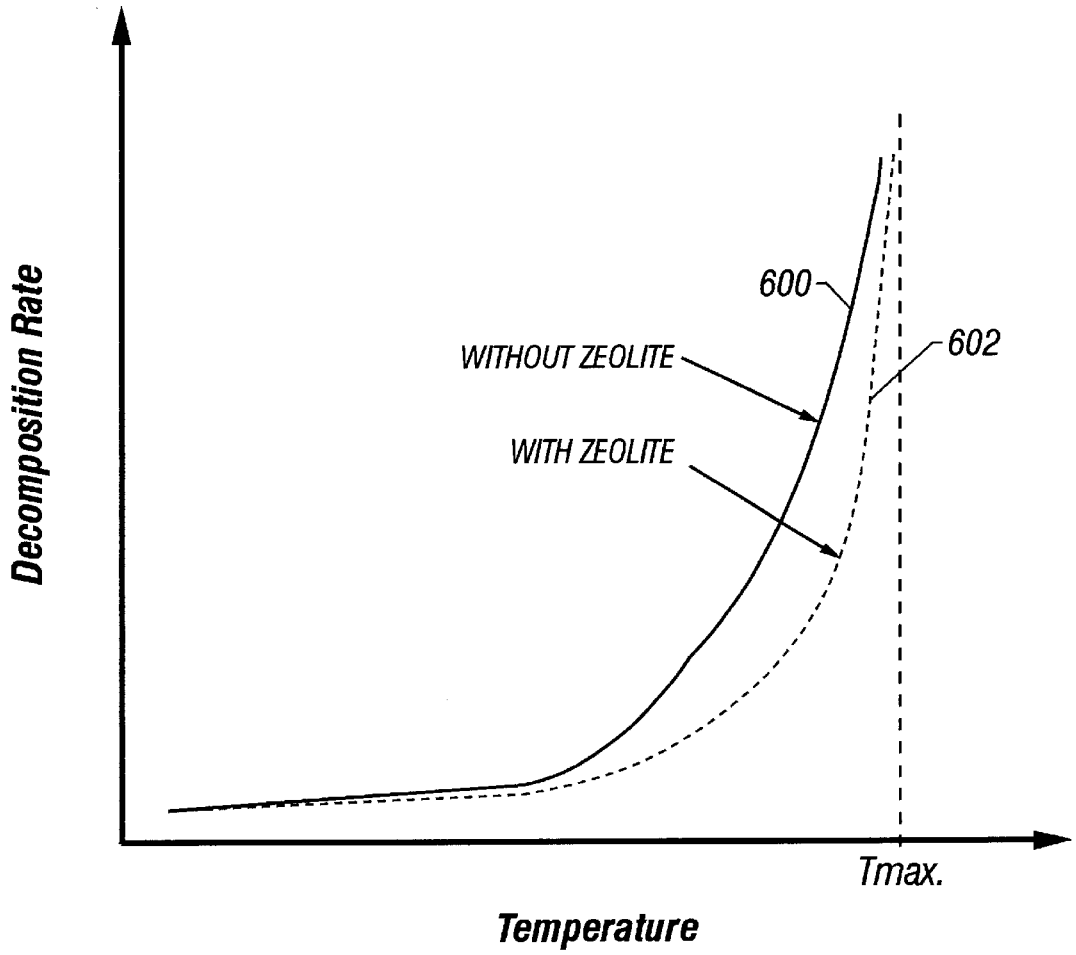
FIG. 7 illustrate graphs representing decomposition rates of an explosive with increasing temperature.

Referring to FIG. 7, graphs 600 and 602 illustrate a reduction in the decomposition rate if zeolite is used. The graph 600 represents the decomposition rate without zeolite as temperature increases. The graph 602 represents the decomposition rate with zeolite as temperature increases.

Other downhole tools that may contain explosives include firing heads, setting tools in which an explosive element is used for activation, disappearing plugs in which an explosive is used to shatter a plug, tools with propellants, and so forth.

Figure 10:
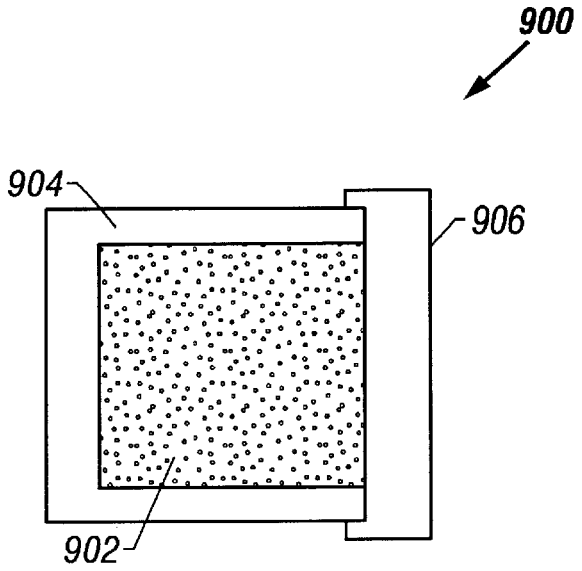
FIG. 10 illustrates a module having a container and an adsorptive material, with the container formed at least in part of a relatively low melting temperature material.

Referring to FIG. 10, a temperature-activated module 900 includes a container 904 containing an adsorptive material 902. A cap 906 is secured to the container 904 so that a hermetically sealed chamber is provided. The cap 906 is made of a relatively low melting temperature material that melts away at a predetermined temperature (such as downhole temperatures). In one embodiment, the cap may be formed of a eutectic material. An advantage of a eutectic material is that upon reaching its melting temperature, it turns into liquid form relatively quickly, avoiding a "mushy" state where a mixture of solid and liquid is present. Another advantage of a eutectic material is that a low melting temperature can be achieved.

In operation, to activate operation of the adsorptive material, the temperature of the module 900 is raised, such as by running it downhole, so that the cap 906 melts away and the adsorptive material is exposed to the atmosphere. The module 900 may be placed proximal an explosive. In an alternative embodiment, the whole container may be formed of the low melting temperature material.

Although reference has been made to tools for use in wellbores in the described embodiments, methods and apparatus according to further embodiments may be employed with surface tools. For example, such surface tools may include tools used in mining operations that may carry explosive components. Explosives may also be present in seismic tools, such as equipment used to generate seismic waves into the earth sub-surface for seismic acquisition. Other applications are also possible in further embodiments. Each of these tools, whether at the surface or downhole, includes an element to perform a predetermined operation, either at the surface or downhole.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus comprising:

a housing;

an explosive in the housing; and a module containing an adsorptive material placed in the housing and in the proximity of the explosive to adsorb a corrosive fluid, the explosive outside the module.

2. The apparatus of claim 1, wherein the adsorptive material is adapted to remove a substantial amount of the corrosive fluid from within the housing.

3. The apparatus of claim 1, wherein the adsorptive material is selected from the group consisting of alumina, activated charcoal, calcium-aluminosilicate, montmorillonite clay porcelain, silica gel, a molecular sieve, and a metalsilicate molecular sieve.

4. The apparatus of claim 1, wherein the adsorptive material comprises a molecular sieve.

5. The apparatus of claim 4, wherein the molecular sieve is based on organosilicate or organoaluminosilicate.

6.The apparatus of claim 1, wherein the adsorptive material comprises a metal silicate molecular sieve.

7. The apparatus of claim 1, wherein the metal silicate molecular sieve comprises aluminophosphate.

8. The apparatus of claim 1, wherein the adsorptive material comprises a desiccant.

9. The apparatus of claim 1, wherein the adsorptive material comprises sodium aluminosilicate.

10. The apparatus of claim 1, wherein the adsorptive material comprises a zeolite.

11. The apparatus of claim 1, wherein the adsorptive material may be any one of plural materials to selectively adsorb a predetermined corrosive fluid.

12. The apparatus of claim 1, wherein the housing comprises a hollow gun carrier.

13. The apparatus of claim 1, wherein the housing comprises an adapter for connecting multiple guns, and wherein the explosive comprises one or more booster explosives.

14. The apparatus of claim 1, wherein the adsorptive material is adapted to adsorb a corrosive gas emitted by one or more elements in the housing.

15. The apparatus of claim 1, wherein the explosive is part of an explosive component selected from the group consisting of a shaped charge, a detonating cord, and a booster explosive.

16. The apparatus of claim 1, wherein the housing is sealed from and environment outside the housing.

17. The apparatus of claim 1, further comprising a perforated gun, the perforating gun comprising the housing, the explosive, and the adsorptive material.

18. The apparatus of claim 1, wherein the adsorptive material is selected from the group consisting of alumina, activated charcoal, calcium-aluminosilicate, montmorillonite clay porcelain, and silica gel.

19. A perforating gun string for use in a wellbore, comprising:

an explosive component;

an adsorptive material proximal the explosive component to adsorb a corrosive fluid to protect the explosive component; and a module containing the adsorptive material, the explosive component outside the module.

20. The perforating gun string of claim 19, wherein the explosive component comprises a member selected from the group consisting of a shaped charge, a detonating cord, and a booster explosive.

21. The perforating gun string of claim 20, further comprising plural guns and detonating cords in the guns, the explosive component comprising one or more booster explosives ballistically coupling the detonating cords.

22. The perforating gun string of claim 19, wherein the adsorptive material comprises desiccant.

23. The perforating gun string of claim 19, wherein the adsorptive material is selected from the group consisting of alumina, activated charcoal, calcium-aluminosilicate, montmorillonite clay porcelain, silica gel, a molecular sieve, and a metalsilicate molecular sieve.

24. The perforating gun string of claim 19, wherein the adsorptive material is selected from the group consisting of alumina, activated charcoal, calcium-aluminosilicate, montmorillonite clay porcelain, and silica gel.

25. A method of protecting an explosive in a high-temperature environment, comprising;

positioning an adsorptive material effective at a temperature greater than about 140° F. proximal the explosive to adsorb a corrosive fluid to protect the explosive, wherein positioning the adsorptive material comprises placing the adsorptive material in a container and positioning the container in a tool containing the explosive; and removing the container from a sealed pouch prior to positioning the container.

26. The method of claim 25, wherein positioning the adsorptive material comprised positioning a material selected from the group consisting of alumina, activated charcoal, calcium-aluminosilicate, montmorillonite clay porcelain, silica gel, a molecular sieve, and a metalsilicate molecular sieve.

27. The method of claim 25, further comprising puncturing a cover around the adsorptive material.

28. The method of claim 25, further comprising selecting and adsorptive material that is effective at a temperature greater than about 200° F.

29. The method of claim 25, wherein positioning the adsorptive material comprises positioning a material selected from the group consisting of alumina, activated charcoal, calcium-aluminosilicate, montmorillonite clay porcelain, and silica gel.

30. A tool for use in a wellbore, comprising an element for performing a downhole operation, an explosive; and one or more modules containing and adsorptive material to adsorb corrosive fluid, wherein each of the one or more modules comprises a container in which the adsorptive material is placed; and wherein the container comprises a member selected from the group consisting of a metal screen, a metal mesh, and a porous plastic.

31. A tool for use in a wellbore, comprising an element for performing a downhole operation;

an explosivbe;

one or modules containing an adsorptive material to adsorb corrosive fluid, wherein each of the one or more modules comprises a container in which the adsorptive material is placed; and a pouch in which the container may be initially stored, the pouch formed of a material impervious to gas.

32. The tool of claim 31, wherein the material of the pouch comprises a metalized plastic film.

33. An apparatus for use in a wellbore, comprising:

an explosive;

a protective material positioned proximal the explosive to interact with a corrosive fluid at an elevated wellbore temperature to protect the explosive; and a module containing the protective material, the explosive being outside the module.

34. The apparatus of claim 33, wherein the protective material reacts with the corrosive fluid.

35. The apparatus of claim 33, wherein the protective material traps the corrosive fluid.

36. The apparatus of claim 33, wherein the protective material prevents or reduces interaction of the corrosive fluid and the explosive.

37. The apparatus of claim 33, wherein the explosive comprises a propellant.

38. The apparatus of claim 33, wherein the protective material is selected from the group consisting of alumina, activated charcoal, calciumaluminosilicate, montmorillonite clay porcelain, silica gel, a molecular sieve, and a metalsilicate molecular sieve.

39. A tool for use in a wellbore, comprising an element for performing a downhole operation;

an explosive; and one or more modules containing an adsorptive material to adsorb corrosive fluid, wherein the explosive is located outside the one or modules.

40. The tool of claim 39, wherein each of the one or more modules comprises a container in which the adsorptive material was placed.

41. The tool of claim 40, wherein the container comprises one or more openings.

42. The tool of claim 39, wherein each of the one or more modules comprises a cover for the adsorptive material.

43. The tool of claim 42, wherein adsorptive material is in the form of pellets, powder, or beads.

44. A tool for use in a wellbore, comprising an element for performing a downhole operation;

an explosive; and one or more modules containing an adsorptive material to adsorb corrosive fluid, wherein each module has an element adapted to pierce a portion of the module.

* * * * *